US010307664B1

(12) United States Patent
Villela

(10) Patent No.: US 10,307,664 B1
(45) Date of Patent: Jun. 4, 2019

(54) INTERACTIVE COMPETITIVE DICE ROLLING BOARD-GAME

(71) Applicant: Shawn Christopher Villela, Algonquin, IL (US)

(72) Inventor: Shawn Christopher Villela, Algonquin, IL (US)

( * ) Notice: Subject to any disclaimer, the term of this patent is extended or adjusted under 35 U.S.C. 154(b) by 0 days.

(21) Appl. No.: 15/809,678

(22) Filed: Nov. 10, 2017

(51) Int. Cl.
*A63F 3/00* (2006.01)
*A63F 9/04* (2006.01)

(52) U.S. Cl.
CPC ..... *A63F 9/0402* (2013.01); *A63F 3/00003* (2013.01)

(58) Field of Classification Search
CPC ..... A63F 7/06; A63F 7/00
See application file for complete search history.

(56) References Cited

U.S. PATENT DOCUMENTS 2,926,915 A 1/1958 Johns
3,391,933 A * 7/1968 Cooper ..... A63F 7/06 273/108.5
3,428,317 A * 2/1969 Pulcifer ..... A63F 7/0608 273/108.32
4,025,073 A 5/1977 Furr
4,261,569 A * 4/1981 Frohlich ..... A63F 3/00031 273/244.2
7,309,485 B2 12/2007 He et al.
7,325,807 B1 2/2008 Eason
9,570,507 B2 2/2017 Nozaki et al.
9,782,666 B2 * 10/2017 Dahl ..... A63F 7/0017
2010/0148434 A1 * 6/2010 Brustmeyer ..... A63B 67/066 273/108
2016/0038809 A1 * 2/2016 Rockwell ..... A63B 67/06 273/401

* cited by examiner

*Primary Examiner* — Eugene L Kim
*Assistant Examiner* — Christopher A Glenn

(57) ABSTRACT

A dice rolling table game that comprises of a pair of teams that compete against each other by rolling their dice onto a game-board with multiple holes and flat surfaces that are prescribed a certain amount of points if the dice land onto the said areas, if the dice does not roll onto the board it will not count. If the dice rolls off the board, this may negatively affect the team that threw the dice or positively affect the defense that caught the dice. Games are played to a certain amount of points and the first to reach those points and win by two points, wins the game. Open containers, which are referred to as "post-cups," are involved in the game, but are not filled with any liquids. The post-cups may be used to toss and catch the dice. There are more than one game modes that will be described in this present invention, but are not limited to in relation to the described invention. There are different rules and said cups may not be used depending on the type of game-mode that is being played on said invention.

19 Claims, 5 Drawing Sheets

INTERACTIVE COMPETITIVE DICE ROLLING BOARD-GAME

CROSS-REFERENCE TO RELATED APPLICATIONS

None.

BACKGROUND OF THE INVENTION

A frequent way for people to relieve stress and have fun is to go to parties, gatherings, social outings, etc. One of the most common ways for people to enjoy their time at social gatherings is to play a party game/backyard game. When healthy competition between groups of individuals is introduced, the competition often has an ability to heighten the level of joy at a party. Not only that, but these games have the ability to improve cognitive function, teamwork, and friendship.

Plenty of games exist that have this ability including, but not limited to: Cornholes (Bags), Ladders, Washers. However, a disadvantage of most of these games that they can only be played exclusively outdoor. There are other games that may be played indoor such as darts, pool, and other amusement games such as, but they lack the ability to keep multiple users constantly involved. Another great example is U.S. Pat. No. 905,941 now known as the original "Skee-Ball" game which uses a ramp to thrust a projectile into scoring compartments, but again, only has the ability to keep one used involved at a time. One of the games that has become recently popularized is U.S. Pat. No. 7,325,807, otherwise known as "Beer Pong." The major disadvantage of this game is the large amounts of consumption of alcohol that may be ingested during games, the mess it may create, and the users may become overly-inebriated. Also, minors may be present during this game, giving a bad influence. Currently, there are non-alcoholic versions that are played, but are much less popularized.

SUMMARY OF THE INVENTION

This invention relates to recreational amusement board games that includes accessories to play. More specifically, this invention relates to the interactive competitive branch of games in which players of any skill level face off against each other until a final score is reached according to the rules of the game. Any player that dedicates more time may be rewarded with the ability to play at a higher skill level. The game involves skill, chance, and the ability to negatively affect the other teams score.

A game board apparatus for a dice game that is made up of a base having a base front side, a base left side, a base right side and a base back side; and a front ramp on the base front side extending from the base front edge to a center scoring surface. In addition, the game board has the center scoring surface, parallel to the base, extending from the ramp back edge toward, but not reaching the base back side, the center scoring surface with two angling edges from the base left side and base right side towards a fourth scoring crevice located at the intersection of the two angling edges; and two scoring crevices in the center scoring surface, each scoring crevice equal distance from the ramp back edge and equal distance from the base left side for the scoring crevice on the left and the base right side for the scoring crevice on the right. The game board has a third scoring crevice in the center scoring surface, located equidistant between the left base side and the right base side; and a right barrier on the right base side, extending from the base back side towards, but not reaching the right scoring crevice, the right barrier extending above the center scoring surface; as well as a left barrier on the left base side, extending from the base back side towards, but not reaching the left scoring crevice, the left barrier extending above the center scoring surface.

The game board could be made of ABS, wood, or another material. And the game board could be made of one or multiple pieces. For instance, the base, right barrier, left barrier, and scoring surface could each be a separate piece of wood.

The crevices on the game board could be of any shape, for instance the crevices could be round.

The game board could be part of a kit that includes two game boards, perhaps include dice, and perhaps one or more cups for insertion into the crevices. The kit could include a table. The game boards could be positioned on opposite edges of the table, and could be built in to the table.

A method of playing a dice game comprising the placing two game boards on a table, with a base back side of each game board aligned on an edge of the table; then rolling the dice by a player such that the dice are directed at the game board on an opposite side of the table; and catching the dice that roll off of the table, by an opposing player, and adjusting a score. In some embodiments, the score is negatively adjusted if caught by the opposing player. In other embodiments, the score is only adjusted if the dice is caught in a cup held by the opposing player. If the dice are rolled such that the dice stops in a crevice in the game board on the opposite side of the table, the score is adjusted; and if the dice are rolled such that the dice stops in an area of the game board on the opposite side of the table, the score is adjusted.

The dice game wherein the game board is made up of a base having a base front side, a base left side, a base right side and a base back side; and a front ramp on the base front side extending from the base front edge to a center scoring surface. In addition, the game board has the center scoring surface, parallel to the base, extending from the ramp back edge toward, but not reaching the base back side, the center scoring surface with two angling edges from the base left side and base right side towards a fourth scoring crevice located at the intersection of the two angling edges; and two scoring crevices in the center scoring surface, each scoring crevice equal distance from the ramp back edge and equal distance from the base left side for the scoring crevice on the left and the base right side for the scoring crevice on the right. The game board has a third scoring crevice in the center scoring surface, located equidistant between the left base side and the right base side; and a right barrier on the right base side, extending from the base back side towards, but not reaching the right scoring crevice, the right barrier extending above the center scoring surface; as well as a left barrier on the left base side, extending from the base back side towards, but not reaching the left scoring crevice, the left barrier extending above the center scoring surface.

The dice game could be played such that the score is not adjusted if the dice does not stop on the opposite game board. Also, cups could be placed in one or more crevices on the game board, and the score could be adjusted if the dice stops in one of the cups. This adjustment could be negative. All or some of the scoring could be further adjusted based on the information on the top of the dice when it stops, and perhaps only if the dice stops on the game board.

The dice game could be played with two teams with multiple players on each team.

| | | | |
|---|---|---|---|
| 10 | left scoring hole | 12 | right scoring hole |
| 14 | rear scoring hole | 16 | center scoring surface |
| 18 | left barrier | 20 | right barrier |
| 22 | left scoring surface | 24 | right scoring surface |
| 26 | center scoring hole | 28 | front ramp |
| 30 | left slope | 32 | right slope |
| 34 | right rear side of game-board | 36 | left rear side of game-board |
| 38 | left slot | 40 | right slot |
| 42 | left scoring attachment | 44 | right scoring attachment |
| 46 | scoring mechanism | 48 | underside of front ramp |
| 50 | ribs | 52 | underside of left wall |
| 54 | underside of rear | 56 | underside of right scoring surface |
| 58 | underside of right wall | 60 | underside of right scoring crevice |
| 62 | side of post-cup | 64 | post-cup interior |
| 66 | post-cup lip | 68 | post-cup base |
| 70 | table | 72 | game-board with no post-cups |
| 74 | moving dice | 76 | post-cups in game-board |
| 78 | game-board with post-cups inserted | | |

DETAILED DESCRIPTION

FIGS. 1A-1E—First Embodiment

This invention relates to recreational amusement board games that includes accessories to play. More specifically, this invention relates to the interactive competitive branch of games in which players of any skill level face off against each other until a final score is reached according to the rules of the game. Any player that dedicates more time may be rewarded with the ability to play at a higher skill level. The game involves skill, chance, and the ability to negatively affect the other teams score.

Figure 4:
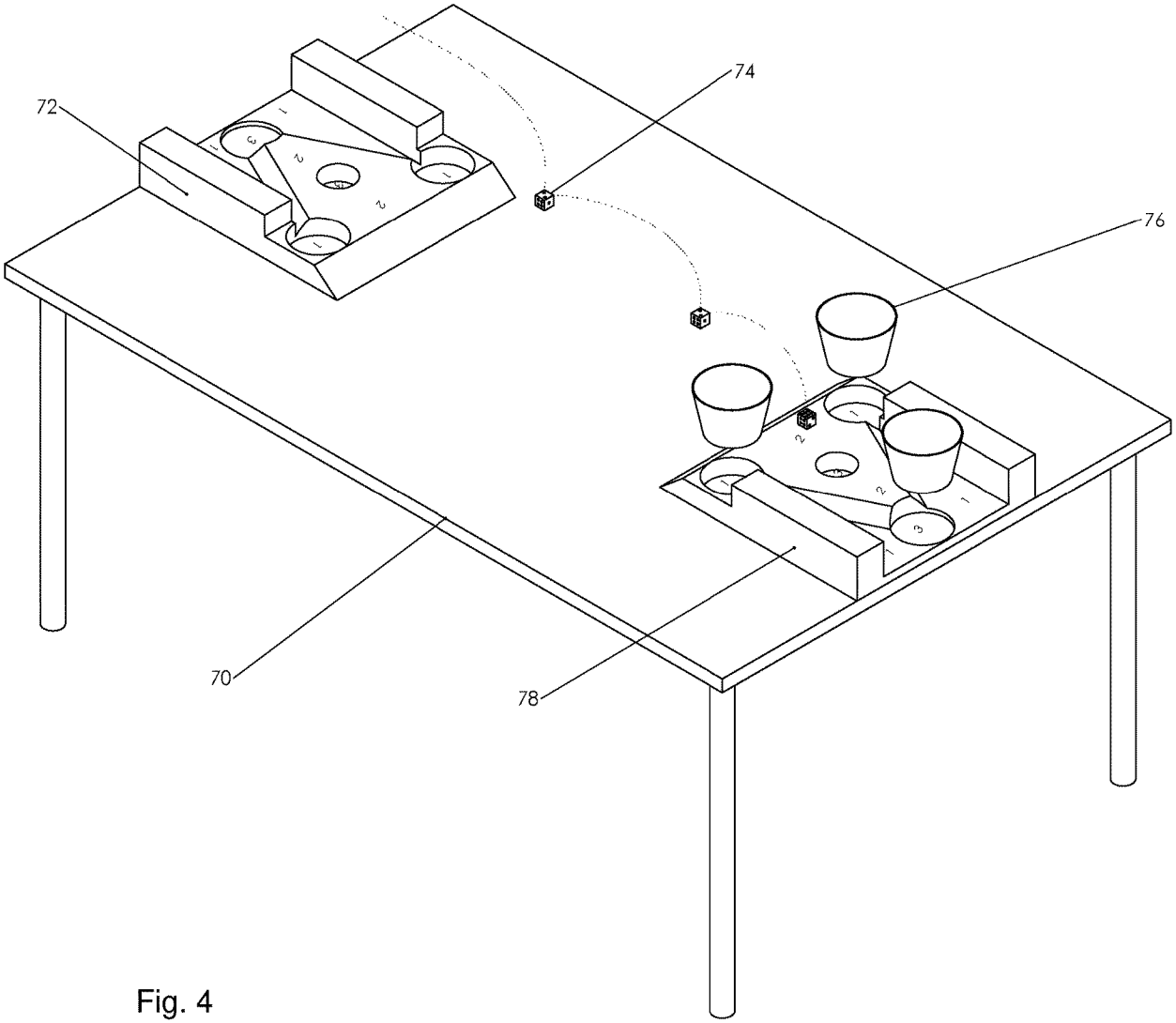
FIG. 4 shows an overall view of two versions of the game-board and their setup Drawings-Reference numerals

Referring to FIG. 4, which shows two different game mode setups that will be further described in the "Operations" section. The subject invention comprises of two (2) game-boards that are laid out on opposite ends of a table 70 with the back corners of the invention at the very edge of the table, but not overlapping the ends of the table. There are six (6) post-cups that are included that can be inserted in the two game-boards (3 post-cups in each), as shown in 76 and 78 or left out, as shown in 72, according to the game mode that the participants choose to play. There are six (6) dice that are included, a carrying case for travel and storage, and a rulebook.

Players simply roll the dice across the table and aim to land their dice onto their opponent's game-board. This game is truly unique in the fact that it is a physically interactive game where players can lose points if a team member accidentally throws the dice off of the table. When this happens the players on defense must rush to try and catch the dice before it hits the ground. If the defensive player catches the dice before hitting the ground, then the offensive team may lose two (−2) points. Also, there are multiple game modes that can be played on this game-board. There are two in particular that are listed in the detailed description, but the listed game modes are not limited to only those games because, there are a variety of different games that can be played using this game-board. For example, rules may be adjusted that reward the defense for catching the dice, such as having the defense gain points. Having multiple game modes that can be played on the same board game is a great way to keep players from getting bored of the same old game, as is the case with many other party games. This game is small and compact with very few accessories, and can be played on any relatively flat surface of any length as long as the dice can roll freely across said surface onto the other board. This game can be played anywhere between two to six (2-6) players. Most present backyard/party games only allow up to four players to play at one time.

In one embodiment, FIG. 1A-1E is typically made of Acrylonitrile Butadiene Styrene (ABS), which is a type of plastic. This embodiment is typically created by way of injection molding so that the present invention can be mass produced at a lower cost. However, any type of material can be used to create this board, such as wood, metal, any other type of durable plastic, etc. A different type of manufacturing method may be suitable to ensure that costs are not high when manufacturing the board with different materials. For instance, in one method of manufacturing the game-board out of wood, the game-board would be made of four solid pieces. The bottom part of the board would most typically be a ½ inch thick and have ¼ inch depth drilled out of the top side of the bottom part of the board to show where the left, right, and center scoring holes would lay on top of it. The center scoring surface would be another piece that measures ¾ in thickness and would have all the scoring holes drilled out completely. This piece would lay right onto the bottom part of the board where the holes would meet and the front ramps would lay in sync with each other. The last two pieces would be the left and right barrier that would sit on the very edges of the board. The bottom most part of the board, center scoring surface, and left and right barriers may be put together with any type of adhesive, screws, nails, etc. Any method that would effectively attach the board pieces together would suffice. This is just one example of how the board may be manufactured out of wood and is not limited to the present example.

Figure 1B:
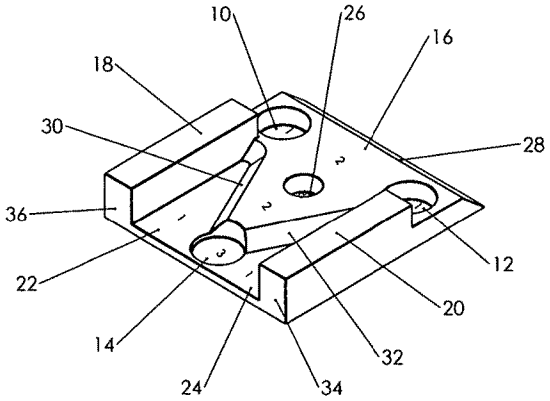
FIG. 1B shows a rear-isometric view of the game-board
Figure 1C:
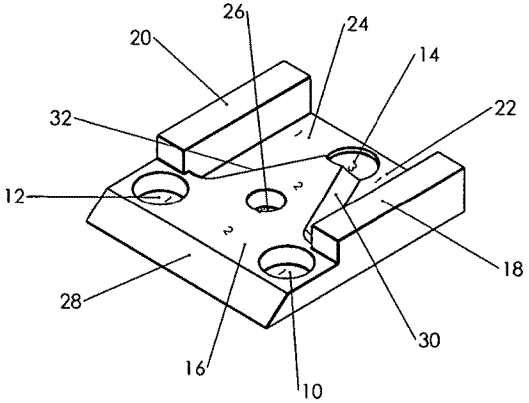
FIG. 1C shows a frontal-isometric view of the game-board
Figure 1A:
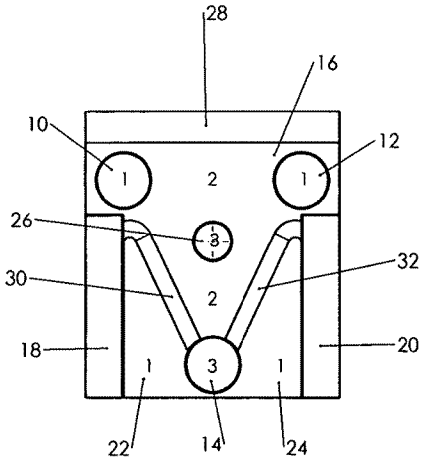
FIG. 1A shows an over-head view of the game-board with all the different areas to score if a player were to land their dice on the specified sections of the board.
Figure 1D:
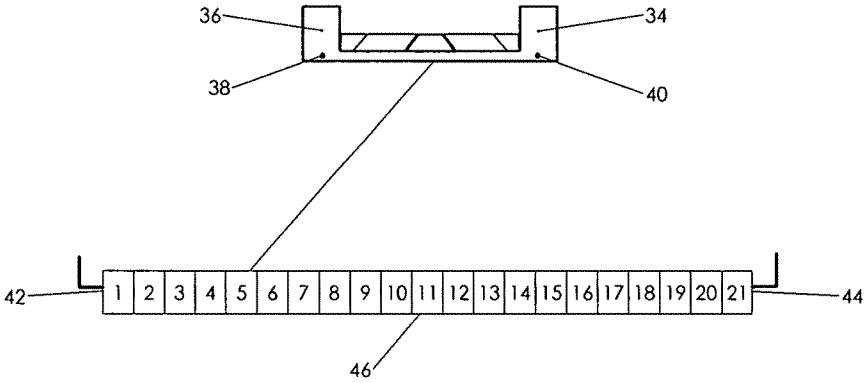
FIG. 1D shows the rear view of the game-board and where a scoring mechanism will be attached to the backside of each of the game-boards to help players keep track of the score
Figure 1E:
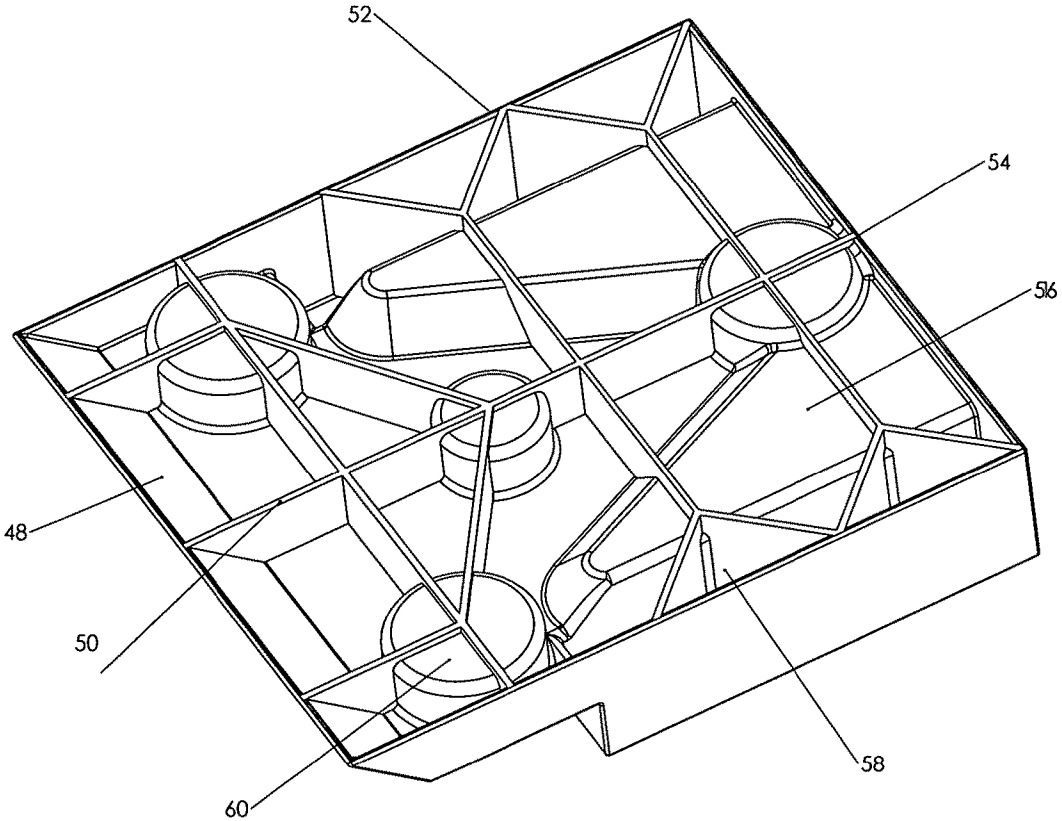
FIG. 1E shows the underside of the game-board
Figure 2A:
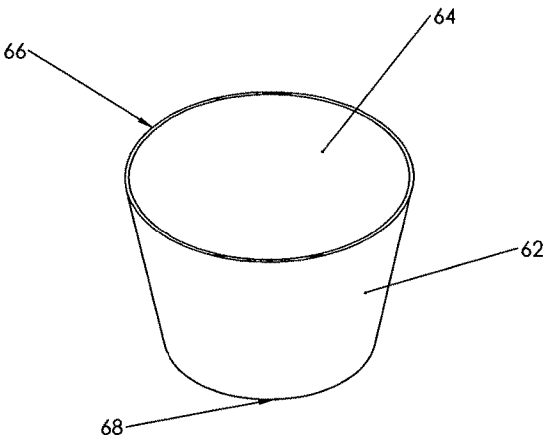
FIG. 2A shows an isometric view of the post-cup that will either be inserted into the board, or used a throwing mechanism for the dice.
Figure 2B:
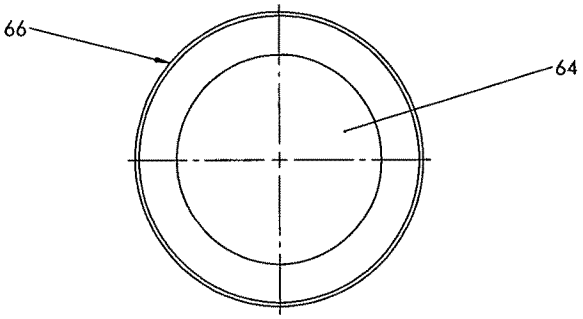
FIG. 2B shows an overhead view of the post-cup
Figure 2C:
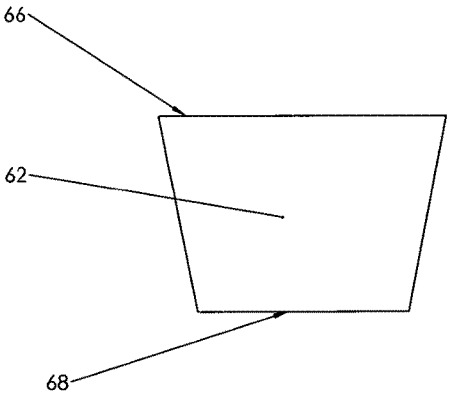
FIG. 2C shows a side view of the post-cup

Shown in FIG. 1E, the entire embodiment will typically have a thickness of ⅛ of an inch as shown (underside of game-board), but may be thicker to ensure durability. It would not be desirable to have the board any less thick than ⅛ inch, although it is attainable. Referring to FIG. 1B, the game-board has an approximate length of 13 inches long and an approximate width of 11.75 inches. The present embodiment has an approximate maximum height of 2.5 inches where the barriers 18 and 20 are shown. The front ramp 28 will stand at an approximate height of 1.25 inches tall, with a slope angled at approximately 39.81 degrees, and a width of 1.25 inches before it meets the center scoring surface 16.

All the aforementioned areas (18, 20, and 28) will all have the same color that is different from the rest of the board to signify that these areas do not count for any points, most typically that color will be red.

The present embodiment features five different areas that consist of three different scoring opportunities. FIG. 1A shows where the center scoring surface 16 meets the front ramp 28. Excluded from the center scoring surface 16 are the left scoring crevice 10, right scoring crevice 12, the center scoring crevice 26, left ramp 30 and right ramp 32. However, the center scoring surface 16 also includes the areas immediately around the left scoring crevice 10 and the right scoring crevice 12.

This center scoring surface has the most surface area available on this present embodiment and will most typically be worth two points and have the color blue to signify this area from the rest of the game-board.

Shown best in FIG. 1A, the left scoring crevice 10 and right scoring crevice 12 are the same size and are approximately 2.5 inches in diameter and have a depth of approximately 1 inch. Both 10 and 12 will most typically be worth one point, and will most typically be colored green. The center scoring crevice 26 is smallest scoring crevice on the board with an approximate diameter of 1.75 inches and a depth of 1 inch. This area is worth three points and will most typically have the color black. Leading away from the center scoring surface and front ramp are the left slope 30 and the right slope 32. Segments 30 and 32 have an approximate angle of 45 degrees and a width of 0.75 inches. Shown best in FIG. 1A, these slopes connect all the way to the left barrier 18 and the right barrier 20, and ends where the rear scoring crevice 14 is attached.

Referring to FIG. 1B, at the base of the slopes are the left scoring surface 22 and the right scoring surface 24. These surfaces end at the base of the left and right barrier (18, 20) on the inside of the game-board and extend out until the edge of the game-board. Both scoring surfaces will typically be worth one point and will be colored green. Shown best in FIG. 1B, is the rear scoring hole 14. The rear scoring hole 14 is the same size as the left and right scoring holes, but the rear scoring hole will typically be worth three points due to the difficulty of landing on this area. The rear scoring hole will typically have the color black to distinguish this area from the others.

FIG. 1D shows the best angle of the rear of the game-board in its entirety. The scoring mechanism 46 is shown in a zoomed in view. The scoring mechanism will help players keep track of their score by having the numbers start to the right of the mechanism and as they score more points, players simply slide over the amount of points the players have scored towards the left side of the mechanism. The scoring mechanism has an attachment on both sides that will be inserted into the back of the game-board during gameplay (42, 44). When the game is stored away this scoring mechanism can detach to help make room for storage. Some players may simply choose not to use the scoring mechanism. When the scoring mechanism 46 is used, players simply take the left scoring attachment 42 and insert it into the left hole 38 and take the right scoring attachment 44 and insert it into the right hole 40.

Referring to FIG. 1E, which shows the underside of the game-board in its entirety. Ribs 50 will typically be inserted throughout the entire game-board to help increase overall durability. The underside of front ramp 48 displays the angle and approximate width of the entire board. Leading back to the underside of the right scoring hole 60, ribs are displayed between the right barrier 58 and the right scoring surface 56. FIG. 1E typically displays how the game-boards injection mold will not just be one solid chunk of material, but rather, a slender, durable game-board that will be as cost effective as possible when manufacturing.

Moving on to the game-board accessories, which are shown in FIG. 2A-FIG. 3B. Starting with FIG. 2A-FIG. 2C, which shows the post-cup in its entirety. The post-cups are a typical view of standard 15 oz. "tumbler," such as sold by the company U.S. Acrylic, LLC. The post-cups will stand approximately 4.50 inches tall 62, have an opening "mouth" 64 diameter of 3.625 inches, have a base 68 of 2.75 inches, and an approximate overall thickness 66 of 0.125 inches. These post-cups have a wide range of uses and whatever their use may be depends on the type of game mode that is played on this game-board.

Figure 3A:
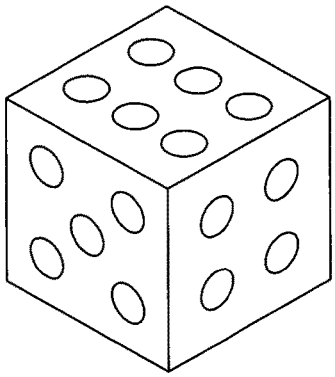
FIG. 3A shows an isometric view of a standard sixteen (16) millimeter playing die.
Figure 3B:
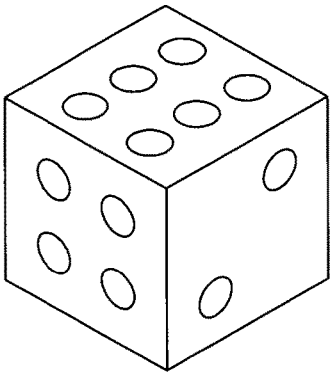
FIG. 3B shows another isometric view of a standard sixteen (16) millimeter playing die

Now referring to FIG. 3A and FIG. 3B. This illustration shows two isometric views of a standard sixteen-millimeter die. This will be the main accessory of the game, but the range is not limited to a certain size or shape of die and many other types of projectiles may be used in this present invention.

Referring to FIG. 4 which shows a complete overall view of how the games will typically be set up. As shown in FIG. 4, both boards are at the very end of the table. One way to play game is shown in 72, where the post-cups will not be inserted into the board. In this game-mode both boards will not have any post-cups in it and the players will use their post-cups to throw and catch the dice 74. On the right side, the post-cups 76 are seen "hovering" above the game-board 78 to show where the post-cups will be completely inserted into the game-boards left, right, and rear scoring holes.

Operations

There are many different ways this said invention can be used, and is not limited to this sections description. This game may be played on any relatively flat surface (most typically a raised surface), any size, anywhere. There are a few precautions to the setup of the game, but are not completely necessary. This setup merely ensures that the game can be played with very few hindrances. Firstly, there needs to be enough space between the two game-boards that the die can roll freely from one side of the table. Secondly, all objects not included in the game and not being used should be removed from the surface that would interrupt the path of the die being rolled. Thirdly, the flatter and smoother of a surface will allow the dice to roll more freely. Lastly, any chairs or objects that could get in the way of players movement should be moved away from the surface to help players be able to catch the dice freely as well, as a safety precaution.

This game can be played one vs one (1v1) player, two vs two (2v2) players, or three vs three (3v3) players. There is no limitation to how many players and teams can play (4v4, 5v5, 6v6, etc.), but there must be enough dice to go around for each player. This is a major advantage of this present invention due to the fact that more players may be involved in the game. Each player/team stands on one side of the surface, while the opponent(s) stand together on the opposite side of the table. The game-board that each team aims to roll their dice onto is the game-board that is located across the table. The game-boards are placed rear side at the very edge of the surface, but not overlapping the edge. The game-boards front ramp (FIG. 1C, 28) will face the opponent(s).

There are many different types of game play that can be used on this game-board. Only two will be described in greater detail in this section. First to be described will be Game Mode #1. Game Mode #1 begins by having the teams insert the post-cups into the left, right, and rear scoring holes 10, 12, and 14 (FIG. 1A) in both game-boards. This makes it harder to land the dice on the board, and the post-cups will act as "bumpers." Each teammate receives two (2) dice to be rolled one at a time, and the dice can be rolled in any order. If the game is one vs one (1v1), then four (4) dice are given to each player. If the game is three vs three (3v3) or two vs two (2v2), then two (2) dice are given to each player. There is no limitation to how many dice each player can have in terms of custom rules that players may want to include.

To determine which player/team starts the game, a player from each team will roll a single die anywhere on the table at the same time as an opposing player does. Whichever player rolled the higher value on the die starts the game. If the dice are tied, keep rolling the dice until one player has a dice that has a greater value than the opponent. Any player on the team can start the game, and the dice can be rolled in any order. Players simply roll the dice onto the table and aim to land their dice onto the opponent's game-board. Whoever rolls the dice must be standing behind the surfaces edge, and their elbows must be behind the surfaces edge at the release point of their dice. The dice must roll and cannot be slid across the surface. Also, the dice must hit the surface before hitting the opposing team's game-board (players may not toss the die directly onto the game-board). Committing one of the previous infractions will cause the dice to be counted as invalid, and the player will lose their roll and it will not count for any points.

Now referring to FIG. 1A-FIG. 1D, there are four areas on the game-board that counts for points if the dice lands on them in Mode #1. Specifically referring to FIG. 1A, the center scoring surface 16 counts for two points and will also have a label of "2." The center scoring hole 26 counts for three points and will be labeled with a "3." The left and right scoring surfaces 22, 24 counts for one point and will be labeled "1." If the dice is hanging off the center scoring surface, or touching one of the slopes 30, 32 then, it only counts for one point.

The unique part involves the fact that players can lose points. However, teams/players cannot go into negatives, unless a custom rule would like to be integrated. There may be similar alternative game modes that allow users to go into negatives, but will not be described in detail in this section. In one example, a negatives rule may likely be incorporated to help with mathematical skills for educational purposes.

Moving on, in Game Mode #1, the lowest score any team can have is zero. There are two ways in which an offense can lose points from rolling their dice. One way is to roll your dice into one of the post-cups that are already inserted into the left, right, and rear scoring holes. Referring to FIG. 1C, if a dice rolls off the front ramp 28 and lands in the post-cups that are inserted in one of the scoring holes, the offensive team that is rolling the dice loses one point. Also, a positive aspect may be integrated where players who roll their dice into the post-cups may be rewarded points for landing in those spots instead of losing points.

Another unique aspect of the present invention is that players may lose if a player rolling the dice falls off the surface. If the dice falls anywhere off the surface after the dice has been rolled, the opposing team can attempt to catch the dice before the dice hits the ground. If the dice is caught by the defense, the defense must immediately shout out, "Diced!" Once "Diced!" is called out, the offensive team (the one who is rolling the dice) loses two points. The shouting of, "Diced!" lets the offense know that a die has been caught, and this also heightens the excitement of gameplay and is seen to be a very fulfilling reward on behalf of the defense. If the dice hits the ground in any fashion, then no point deduction can be taken from the offense's score. An alternative to the offense losing points if the defense catches the dice may be rewarding the defense points to their score instead of the offense losing points. This would be a positive reflection of the score on behalf of the defense. For instance, if the defense catches the dice and their score is already at 12 points, this would mean that their score may be 14 points—a positive gain of two points for the defense instead of the offense losing two points.

Referring to FIG. 1A, there are limited spaces to land the die on the board. Once the die rolls up the ramp 28 and makes it past the post-cups (where spaces 10 and 12 are), only the center scoring surface 16 (worth two points), center scoring hole 26 (worth three points), the left and right scoring surface 22, 24 (each worth one point) are the only places that the dice may land and count for points. Again, spaces 10, 12, and 14 will be filled with post-cups that are considered negatives for this particular game mode.

After a team has rolled all their dice, the offensive team may then use their game-board (the one closest to them) to tally up the score using the scoring mechanism 46, as seen in FIG. 1D. Players must add any points they have made as well as deduct any points that may have incurred. After scoring is completed the other team may then begin rolling their dice. The scoring mechanism is optional to use, and if the teams prefer, they can simply add and deduct the points by memory to work on their memorization skills.

Moving on towards another example of a gameplay on this present invention is Game Mode #2. Game Mode #2 is played on the same game-board, but with different rules. Most of the rules are the same. However, the major difference between Game Mode #1 and Game Mode #2 is that the post-cups are not to be inserted into the dice game-board. This allows more spots on the game-board to be counted as points to score. Referring to FIG. 1A, each spot where the post-cup would have been inserted should now be left open (10, 12, and 14). The left hole 10 and the right hole 12 will be worth one point and will be labeled with a "1." The rear scoring crevice 14 is now worth three points and will be labeled with a "3."

Another unique aspect of the present invention in Game Mode #2 is that each player must use one of the post-cups to roll their dice (on offense) and also catch the opposing teams dice (on defense) if the dice fall off the table. On offense, players may only roll one dice at a time in their post-cups. On defense, any dice that are caught must remain in the post-cup until the round is over in order for the point deduction to remain. If a dice falls out of the post-cup, the point deduction for that caught dice will not count. Dice may only be caught if the defense can catch it with their post-cup. Alternatively, players may choose to have the catching of the dice in the post-cups count for a positive gain of points for the defense.

To conclude, in both Game Mode #1 and #2, once a team has reached twenty-one points with a score equal to, or greater than two points of the other teams score, will then put the opposing team on game point. There is a chance for a rebuttal once game point has been reached. The game may be won when a team has put the opposing team on game point, and after the opposing team's rebuttal, they were not able to come within two points. If the team that was down two points or more comes within two points then, the game continues as normal until game point can be kept after their rebuttal.

Lastly, there is one more game mode variation that may be included in this present invention. Labeling the die with bonus attributes or features may be added to make the game more intriguing. For instance, instead of the die have dots that show their number value on them, the die may be labeled with bonus features like "+2," "Extra Roll," "−1", etc. There are endless amounts of variants that may be included and are not limited to the present examples. In many instances, there can also be educational aspects incorporated into the die.

CONCLUSION, RAMIFICATIONS, SCOPE

Thus, the reader will see that at least one embodiment of this interactive and competitive dice rolling table game provides a pleasantly different and creative spin on tabletop games than the present party games that exist. This game can be played by kids and adults alike, indoors and outdoors, and does not need alcohol to keep users interested and involved.

While my above description contains many specificities, these should not be construed as limitations on the scope, but rather as an exemplification of one [or several] embodiment(s) thereof. Many other variations are possible. For example, this game-board may be created out of many different materials such as wood, metal, or other various types of plastic. If said materials are used it may require a different manufacturing method and may require a slightly different design in the board. Also, the game-board may come in many different shapes, colors, and sizes that are best fit for the manufacturer. All present embodiments such as the post-cup, dice, scoring crevices, and scoring surfaces are not limited to the present measurements, but are merely an approximation that may be viewed as standard. Accordingly, the scope should be determined not by the embodiment(s) illustrated, but by the appended claims and their legal equivalents.

The invention claimed is:

1. A game board apparatus for a dice game comprising: a base having a base front side, a base left side, a base right side and a base back side; a front ramp on the base front side extending from the base front edge to a center scoring surface; the center scoring surface, parallel to the base, extending from the ramp back edge toward, but not reaching, the base back side, the center scoring surface with two angling edges from the base left side and base right side towards a fourth scoring crevice located at an intersection of the two angling edges; two scoring crevices in the center scoring surface, each scoring crevice located an equal distance from the ramp back edge and located an equal distance from the base left side for the scoring crevice on the left and the base right side for the scoring crevice on the right; a third scoring crevice in the center scoring surface, located equidistant between the base left side and the base right side; a right barrier on the base right side, extending from the base back side towards, but not reaching the right scoring crevice, the right barrier extending above the center scoring surface; and a left barrier on the base left side, extending from the base back side towards, but not reaching the left scoring crevice, the left barrier extending above the center scoring surface.

2. The apparatus of claim 1 wherein the base, right barrier, left barrier, and scoring surface are made of Acrylonitrile Butadiene Styrene (ABS).

3. The apparatus of claim 1 wherein the base, right barrier, left barrier, and scoring surface are made of wood.

4. The apparatus of claim 3 wherein the base, right barrier, left barrier, and scoring surface are each a separate piece of wood.

5. The apparatus of claim 1 further comprising one or more cups for insertion in one or more crevices.

6. The apparatus of claim 1 wherein the first and second scoring crevices are round.

7. The apparatus of claim 1 further comprising a second game board apparatus identical to the game board apparatus of claim 1.

8. The apparatus of claim 7 further comprising a table, said game board apparatus and second identical game board apparatus positioned on opposite edges of the table.

9. The apparatus of claim 1 further comprising one or more dice.

10. A method of playing a dice game comprising:

placing two game boards on a table, with a base back side of each game board aligned on an edge of the table;

rolling the dice by a player such that the dice are directed at the game board on an opposite side of the table;

catching the dice that roll off of the table, by an opposing player, and adjusting a score;

rolling the dice such that the dice stops in a crevice in the game board on the opposite side of the table, and adjusting the score; and rolling the dice such that the dice stops in an area of the game board on the opposite side of the table, and adjusting the score;

wherein the game board comprises:

a base having a base front side, a base left side, a base right side and a base back side;

a front ramp on the base front side extending from a base front edge to a center scoring surface;

the center scoring surface, parallel to the base, extending from a ramp back edge toward, but not reaching the base back side, the center scoring surface with two angling edges from the base left side and base right side towards a fourth scoring crevice located at an intersection of the two angling edges;

two scoring crevices in the center scoring surface, each scoring crevice equal distance from the ramp back edge and equal distance from the base left side for the scoring crevice on the left and the base right side for the scoring crevice on the right;

a third scoring crevice in the center scoring surface, located equidistant between the base left side and the base right side;

a right barrier on the base right side, extending from the base back side towards, but not reaching the right scoring crevice, the right barrier extending above the center scoring surface; and a left barrier on the base left side, extending from the base back side towards, but not reaching the left scoring crevice, the left barrier extending above the center scoring surface.

11. The method of claim 10 wherein the adjustment of the score for catching the dice that rolls off of the table adjusts the score in a negative direction for the player who rolled the dice.

12. The method of claim 10 further comprising multiple players and multiple opposing players on two teams.

13. The method of claim 10 further comprising placing cups in one or more of the crevices, and rolling the dice such that the dice stops in the cup, and adjusting the score.

14. The method of claim 13 wherein the score is adjusted in a negative direction when the dice stops in the cups.

15. The method of claim 10 further comprising rolling the dice such that the dice are in a location that is not on the game board and on the opposite side of the table, and not adjusting the score.

16. The method of claim 10 wherein the opposing player catching the dice catches the dice in a cup.

17. The method of claim 10 wherein the score is further adjusted based on information on a top surface of the dice.

18. The method of claim 17 wherein the score is only adjusted with information on the top of the dice if the dice stops on the game board.

19. The method of claim 16 wherein the opposing player rolls the dice directly from the cup.

* * * * *